US011803163B2

(12) United States Patent
Nakajima

(10) Patent No.: US 11,803,163 B2
(45) Date of Patent: Oct. 31, 2023

(54) ELECTRONIC WATCH

(71) Applicant: Seiko Epson Corporation, Tokyo (JP)

(72) Inventor: Yasuo Nakajima, Matsumoto (JP)

(73) Assignee: SEIKO EPSON CORPORATION

( * ) Notice: Subject to any disclaimer, the term of this patent is extended or adjusted under 35 U.S.C. 154(b) by 434 days.

(21) Appl. No.: 17/089,898

(22) Filed: Nov. 5, 2020

(65) Prior Publication Data

US 2021/0132550 A1 May 6, 2021

(30) Foreign Application Priority Data

Nov. 6, 2019 (JP) ..... 2019-201255

(51) Int. Cl.

| | |
|---|---|
| ***G04G 9/02*** | (2006.01) |
| ***G04G 17/04*** | (2006.01) |
| ***G04R 20/26*** | (2013.01) |
| ***G04C 10/02*** | (2006.01) |
| ***G04C 3/14*** | (2006.01) |
| ***G04R 60/12*** | (2013.01) |
| ***G04R 20/02*** | (2013.01) |

(52) U.S. Cl.

CPC ..... *G04G 9/027* (2013.01); *G04C 3/146* (2013.01); *G04C 10/02* (2013.01); *G04G 17/045* (2013.01); *G04R 20/02* (2013.01); *G04R 20/26* (2013.01); *G04R 60/12* (2013.01)

(58) Field of Classification Search

CPC ..... G04G 9/027; G04G 17/045; G04G 17/04; G04G 17/083; G04R 20/26; G04R 60/12; G04R 20/02; G04C 10/02; G04C 3/146

See application file for complete search history.

(56) References Cited

U.S. PATENT DOCUMENTS

2004/0233789 A1* 11/2004 Oguchi ..... G04G 21/04 368/47
2006/0114750 A1* 6/2006 Iida ..... G04R 20/08 368/67
2010/0238077 A1* 9/2010 Cho ..... H01Q 3/267 343/703

(Continued)

FOREIGN PATENT DOCUMENTS

JP 2014-169869 A 9/2014

*Primary Examiner* — Sean Kayes
*Assistant Examiner* — Sean R Brannon
(74) *Attorney, Agent, or Firm* — Harness, Dickey & Pierce, P.L.C.

(57) ABSTRACT

An electronic watch includes a time display, an antenna, a first substrate including a light-emitting element, a second substrate including a light-receiving element, a gear including a through hole passing light from the light-emitting element therethrough, the gear being disposed between the first and second substrates, and first and second conduction members electrically coupling the first and second substrates. The second substrate includes a first wiring electrically coupled to the first substrate via the first conduction member, and a second wiring electrically coupled to the second substrate via the second conduction member. Halfway on at least one of the first and second wirings, a circuit element is coupled in series that, compared to electrical resistance when a direct current flows in the wiring, increases electrical resistance when an alternating current generated by a radio wave received by the antenna flows in the wiring.

11 Claims, 8 Drawing Sheets

(56) References Cited

U.S. PATENT DOCUMENTS

| | | | | |
|---|---|---|---|---|
| 2014/0247700 | A1* | 9/2014 | Honda | G04R 20/06<br>368/21 |
| 2015/0378313 | A1* | 12/2015 | Abe | G04C 10/02<br>368/205 |
| 2019/0324543 | A1* | 10/2019 | Kazdan | G06F 3/011 |

* cited by examiner

ELECTRONIC WATCH

The present application is based on, and claims priority from JP Application Serial Number 2019-201255, filed Nov. 6, 2019, the disclosure of which is hereby incorporated by reference herein in its entirety.

BACKGROUND

1. Technical Field

The present disclosure relates to an electronic watch that includes an antenna and a hand position detection mechanism.

2. Related Art

An electronic watch has been known that includes a hand position detection means that detects a hand position of a pointer, and an antenna that receives a satellite signal transmitted from a Global Positioning System (GPS) satellite (see, for example, JP-A-2014-169869).

The hand position detection means includes a substrate at which a light-emitting element is mounted, a substrate at which a light-receiving element is mounted, and a gear disposed between the respective substrates and having a through hole. This hand position detection means, when a pointer moved by a train wheel including the gear moves to a 12 o'clock position, detects a hand position by receiving light from the light-emitting element by the light-receiving element via the through hole. The respective substrates of the hand position detection means are disposed and spaced from each other with the gear interposed therebetween. Thus, the respective substrates are often conducted to each other mainly using a coil spring.

In an electronic watch that receives a radio wave from an outside, there is a demand for improving reception sensitivity of an antenna.

SUMMARY

An electronic watch of the present disclosure includes a time display unit configured to display a time, an antenna configured to receive a radio wave, a first substrate at which a first element that is one of a light-emitting element or a light-receiving element is mounted, a second substrate at which a second element that is the other of the light-emitting element or the light-receiving element disposed so as to be opposed to the first element is mounted, a gear including a through hole through which light emitted from the light-emitting element and received by the light-receiving element passes through, the gear being disposed between the first substrate and the second substrate, and a first conduction member and a second conduction member configured to electrically couple the first substrate to the second substrate, wherein the second substrate includes a first wiring line electrically coupled to the first substrate via the first conduction member, and a second wiring line electrically coupled to the first substrate via the second conduction member, and a circuit element is coupled in series halfway at least one wiring line of the first wiring line and the second wiring line that, compared to electrical resistance when a direct current flows in the wiring line, increases electrical resistance when an alternating current generated by the radio wave received by the antenna flows in the wiring line.

An electronic watch of the present disclosure includes a time display unit configured to display a time, an antenna configured to receive a radio wave, a first substrate at which a first element that is one of a light-emitting element or a light-receiving element is mounted, a second substrate at which a second element that is the other of the light-emitting element or the light-receiving element disposed so as to be opposed to the first element is mounted, a gear including a through hole through which light emitted from the light-emitting element and received by the light-receiving element passes through, the gear being disposed between the first substrate and the second substrate, and a first conduction member and a second conduction member configured to electrically couple the first substrate to the second substrate, wherein the second substrate includes a first wiring line electrically coupled to the first substrate via the first conduction member, and a second wiring line electrically coupled to the first substrate via the second conduction member, a resistive element is coupled in series halfway at least one wiring line of the first wiring line and the second wiring line, of the first wiring line and the second wiring line, to the wiring line to which the resistive element is coupled in series halfway the wiring line, a bypass wiring line for bypassing the resistive element is coupled, a switch is provided that is configured to select from, as a power supply path from a power source to the first element for supplying power to the first element, a first path via the wiring line to which the resistive element is coupled in series, and a second path via the bypass wiring line, and a control unit is included that, while receiving the radio wave by the antenna, controls the switch to select the first path, and while driving the first element, controls the switch to select the second path.

DESCRIPTION OF EXEMPLARY EMBODIMENTS

First Exemplary Embodiment

An electronic watch 1 of a first exemplary embodiment will be described below with reference to the drawings. In the present exemplary embodiment, description will be given with a side of a cover glass 13 of the electronic watch 1 as a front surface side (upper side), and a side of a case back 12 as a back surface side (lower side).

The electronic watch 1 of the present exemplary embodiment is configured to be able to receive satellite signals from a plurality of location information satellites such as GPS satellites and quasi-zenith satellites that circle above the Earth in respective predetermined orbits, obtain satellite time information, and modify internal time information. Further, the electronic watch 1 is provided with, as reception processing of a satellite signal, in addition to a manual reception function that starts receiving by a user operating a button, an automatic reception function that automatically starts receiving when a predetermined condition is satisfied.

Figure 1:
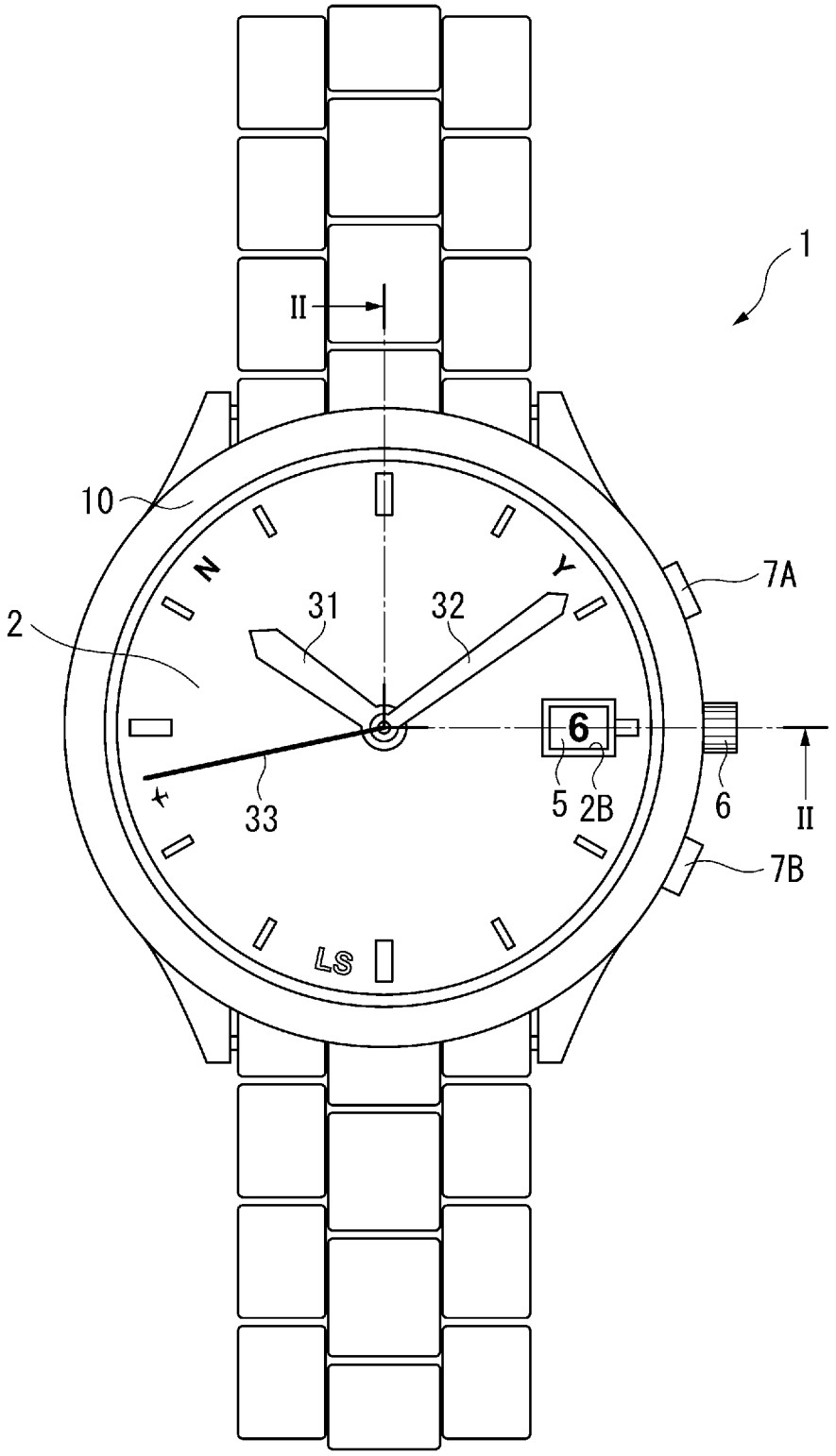
FIG. 1 is a front view illustrating an electronic watch of a first exemplary embodiment.
Figure 2:
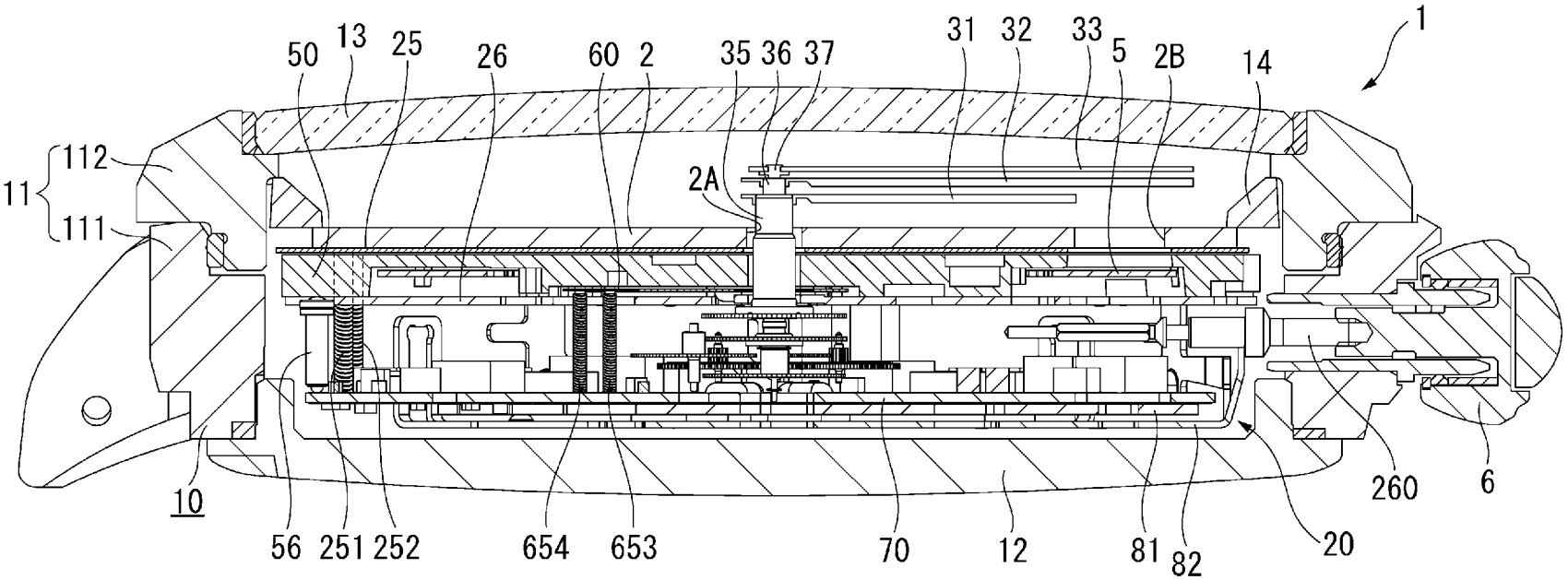
FIG. 2 is a cross-sectional view taken along a line II-II in FIG. 1.

As illustrated in FIG. 1 and FIG. 2, the electronic watch 1 is provided with an outer packaging case 10 that houses a dial 2, movement 20, and the like. Further, the electronic watch 1 also includes a crown 6 for external operation, and two buttons 7A and 7B.

The dial 2 is formed of a non-conductive member such as polycarbonate in a disk shape. A through hole 2A is formed in a planar center of the dial 2, and respective pointer shafts of an hour wheel 35, a center wheel and pinion 36, and a fourth wheel and pinion 37 described later are coaxially disposed in the through hole 2A. The respective pointer shafts are mounted with an hour hand 31, a minute hand 32, and a seconds hand 33. In addition, a rectangular date window 2B is provided at a 3 o'clock position of the dial 2. A date indicator 5 is disposed on a back surface side of the dial 2, and the date indicator 5 is visible through the date window 2B. Thus, in the electronic watch 1, the time display unit for displaying a time is configured by including the dial 2, the hour hand 31, the minute hand 32, and the seconds hand 33.

Note that, FIG. 2 is a cross-sectional view taken along the line II-II in FIG. 1 that connects the 3 o'clock position of the dial 2, the planar center in which the through hole 2A is formed, and a 12 o'clock position to each other.

Outer Packaging Structure of Electronic Watch

The outer packaging case 10 includes a case main body 11, the case back 12, and the cover glass 13. The case main body 11 includes a cylindrical case body 111 and a bezel 112 provided on a front surface side of the case body 111.

On a back surface side of the case main body 11, the case back 12 being disk-shaped that closes an opening on the back surface side of the case main body 11 is provided. Note that, in the present exemplary embodiment, the case body 111 and the case back 12 are configured as separate bodies, but the present disclosure is not limited thereto, and a one-piece case may be used in which the case body 111 and the case back 12 are integrated.

Metal materials such as SUS (stainless steel), titanium alloys, aluminum, and BS (brass) are utilized for the case body 111, bezel 112, and case back 12.

Internal Structure of Electronic Watch

Next, internal structure incorporated in the outer packaging case 10 of the electronic watch 1 will be described.

As illustrated in FIG. 2, the movement 20, a dial ring 14, and the like, in addition to the dial 2 are housed in the outer packaging case 10.

Figure 3:
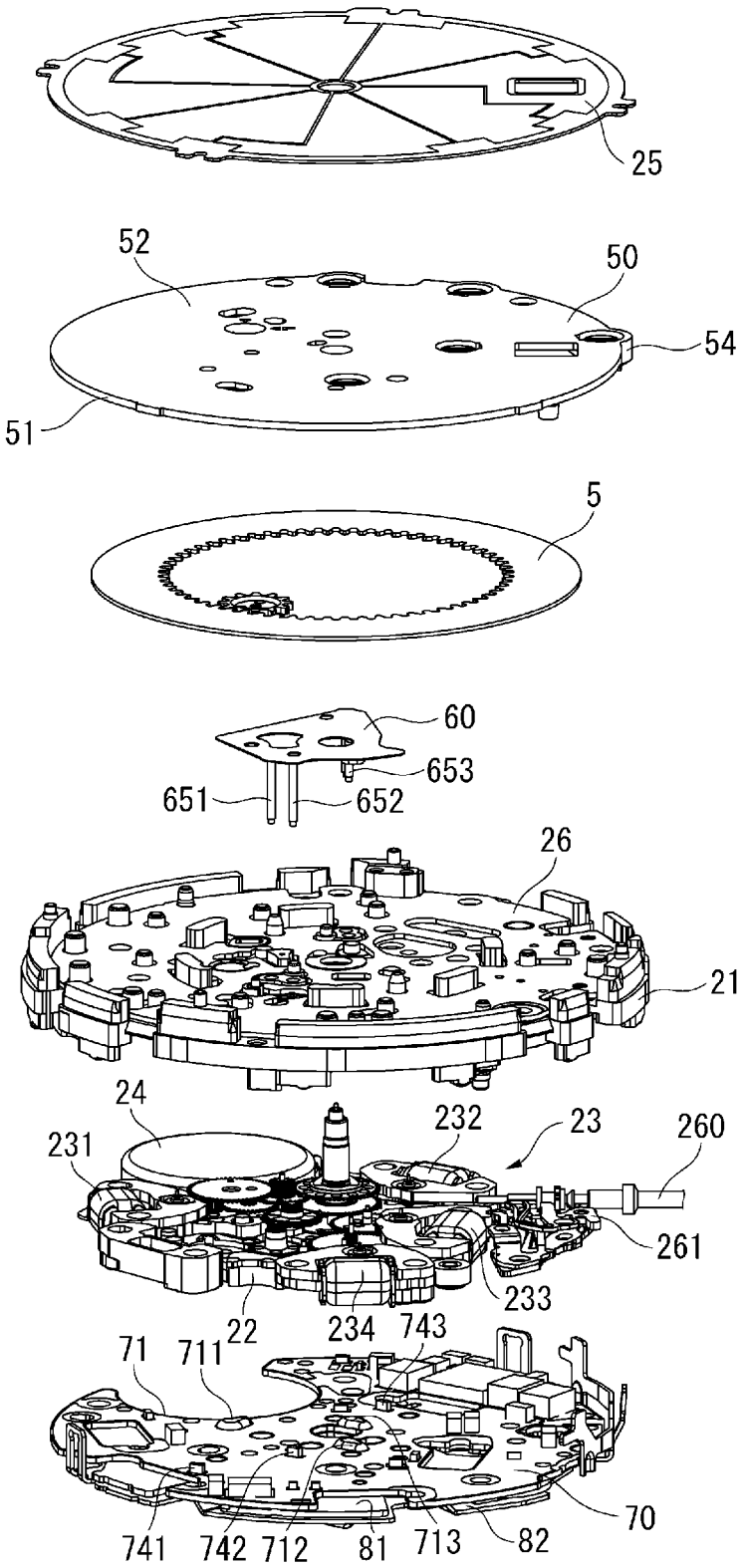
FIG. 3 is an exploded perspective view illustrating a main part of the electronic watch.
Figure 4:
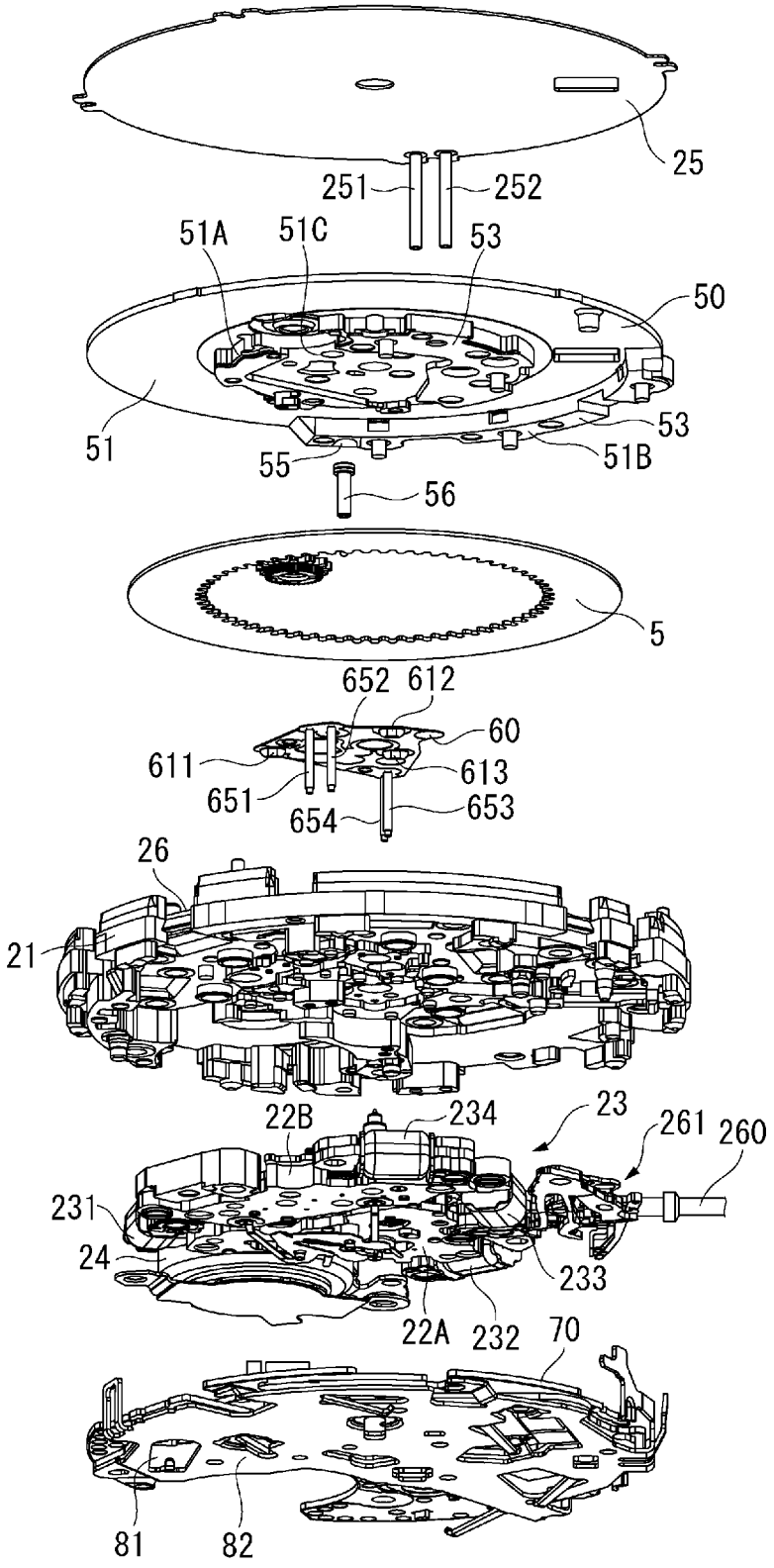
FIG. 4 is an exploded perspective view illustrating the main part of the electronic watch.

As illustrated in FIG. 2, FIG. 3, and FIG. 4, the movement 20 includes the date indicator 5, a main plate 21, a train wheel bridge 22, a driver 23, a secondary battery 24, a solar cell panel 25, a hour wheel holder 26, a planar antenna 50, an LED substrate 60, a printed wired board 70, a magnetic shield plate 81, a circuit cover 82, and the like. Note that, in FIG. 2, the main plate 21, the train wheel bridge 22, the driver 23, and the secondary battery 24 are not illustrated.

The main plate 21 is formed of a non-conductive member such as plastic. The solar cell panel 25, the planar antenna 50, the date indicator 5, the LED substrate 60, and the hour wheel holder 26 are disposed between the main plate 21 and the dial 2. In other words, the planar antenna 50 is disposed on a back surface that is a surface on a side of the main plate 21 of the dial 2, the date indicator 5 and the LED substrate 60 are disposed between the planar antenna 50 and the main plate 21, and as illustrated in FIG. 2 and FIG. 3, the hour wheel holder 26 is disposed between the date indicator 5 and the LED substrate 60 and the main plate 21.

The train wheel bridge 22, the driver 23, the secondary battery 24, the printed wired board 70, the magnetic shield plate 81, and the circuit cover 82 are disposed between the main plate 21 and the case back 12.

As illustrated in FIG. 4, the train wheel bridge 22 includes two train wheel bridges of a first train wheel bridge 22A that supports a train wheel that drives the hour hand 31, the minute hand 32, and the seconds hand 33, and a second train wheel bridge 22B that supports a train wheel that drives the date indicator 5. However, an integrated train wheel bridge may be used.

The driver 23 is disposed on a back surface of the main plate 21, and drives the hour hand 31, the minute hand 32, the seconds hand 33, and the date indicator 5. In other words, as illustrated in FIG. 3, the driver 23 includes a first step motor 231 and a first train wheel that drive the hour hand 31, a second step motor 232 and a second wheel train that drive the minute hand 32, a third step motor 233 and a third train wheel that drive the seconds hand 33, and a fourth step motor 234 and a fourth train wheel that drive the date indicator 5. Note that, the first train wheel includes the hour wheel 35 mounted with the hour hand 31. The second train wheel includes the center wheel and pinion 36 mounted with the minute hand 32. The third train wheel includes the fourth wheel and pinion 37 mounted with the seconds hand 33.

In the movement 20, in plan view viewed from a direction orthogonal to a front surface of the dial 2, that is, from a thickness direction of the electronic watch 1, a winding stem 260 coupled to the crown 6 is disposed at the 3 o'clock position of the dial 2, and a switching mechanism 261, such as a setting lever, is disposed around the winding stem 260.

The step motors 231 to 234 are disposed at respective positions that do not overlap with the secondary battery 24 in the plan view.

LED Substrate and Printed Wired Board

As illustrated in FIG. 3, the LED substrate 60 is disposed between the planar antenna 50 and the hour wheel holder 26, and the printed wired board 70 is disposed on a side of the case back 12 of the driver 23. Thus, the main plate 21 and the driver 23 are disposed between the LED substrate 60 and the printed wired board 70. Further, the magnetic shield plate 81 and the circuit cover 82 are disposed on a back surface of the printed wired board 70.

Figure 5:
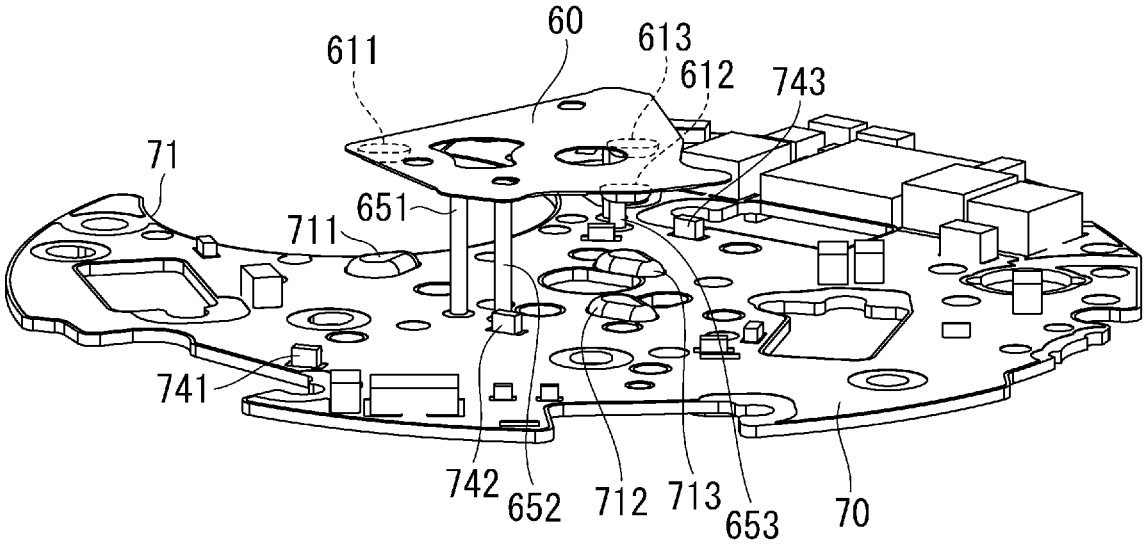
FIG. 5 is a perspective view illustrating an LED substrate and a printed wired board of the electronic watch.

As illustrated in FIG. 4 and FIG. 5, three light-emitting elements 611, 612, and 613 each composed of a light-emitting diode are mounted on a back surface of the LED substrate 60 opposed to the main plate 21.

Both front and back surfaces of the printed wired board 70 are mounted with semiconductor integrated circuits (ICs), and circuit elements such as resistors and capacitors. Then, as illustrated also in FIG. 5, three light-receiving elements 711, 712, and 713 each composed of a phototransistor and circuit elements 741, 742, and 743 are mounted on a front surface of the printed wired board 70, that is, a surface on a side of the dial 2.

Note that, in the present exemplary embodiment, as described in detail below, the LED substrate 60 is a first substrate, and the printed wired board 70 is a second substrate. Thus, each of the light-emitting elements 611, 612, and 613 mounted on the LED substrate 60 is a first element, and each of the light-receiving elements 711, 712, and 713 mounted on the printed wired board 70 is a second element.

In addition, in the present exemplary embodiment, a power supply voltage VDD with high-potential and a power supply voltage VSS with low potential are supplied to the printed wired board 70, via the secondary battery 24 and a constant voltage circuit (not illustrated). Additionally, in the present exemplary embodiment, the power supply voltage VDD is set to ground potential. Note that, the power supply voltage VSS may be set to the ground potential.

Hand Position Detection Mechanism

A configuration is adopted in which light emitted by the light-emitting element 611 reaches the light-receiving element 711 via a through hole formed in the main plate 21 and a through hole provided in a gear of the first train wheel that drives the hour hand 31. The through hole of the gear of the first train wheel is set to be located between the light-emitting element 611 and the light-receiving element 711, when the hour hand 31 points a graduation of 12 o'clock. Thus, the light-emitting element 611 and the light-receiving element 711 constitute a hand position detection mechanism that detects that the hour hand 31 moves to a position to point the graduation of 12 o'clock.

A configuration is adopted in which light emitted by the light-emitting element 613 reaches the light-receiving element 713 via a through hole formed in the main plate 21 and a through hole provided in a gear of the third train wheel that drives the seconds hand 33. The through hole of the gear of the third train wheel is set to be located between the light-emitting element 613 and the light-receiving element 713, when the seconds hand 33 points the graduation of 12 o'clock. Thus, the light-emitting element 613 and the light-receiving element 713 constitute a hand position detection mechanism that detects that the seconds hand 33 moves to the position to point the graduation of 12 o'clock.

A configuration is adopted in which light emitted by the light-emitting element 612 reaches the light-receiving element 712, via a through hole formed in the main plate 21, and respective through holes formed in the hour wheel 35, the center wheel and pinion 36, and the fourth wheel and pinion 37 that overlap with each other in plan view, when the hour hand 31, the minute hand 32, and the seconds hand 33 point the graduation of 12 o'clock. Thus, the light-emitting element 612 and light-receiving element 712 constitute a hand position detection mechanism that detects that the minute hand 32, in addition to the hour hand 31 and the seconds hand 33, moves to the position to point the graduation of 12 o'clock.

Configuration of Printed Wired Board

Figure 6:
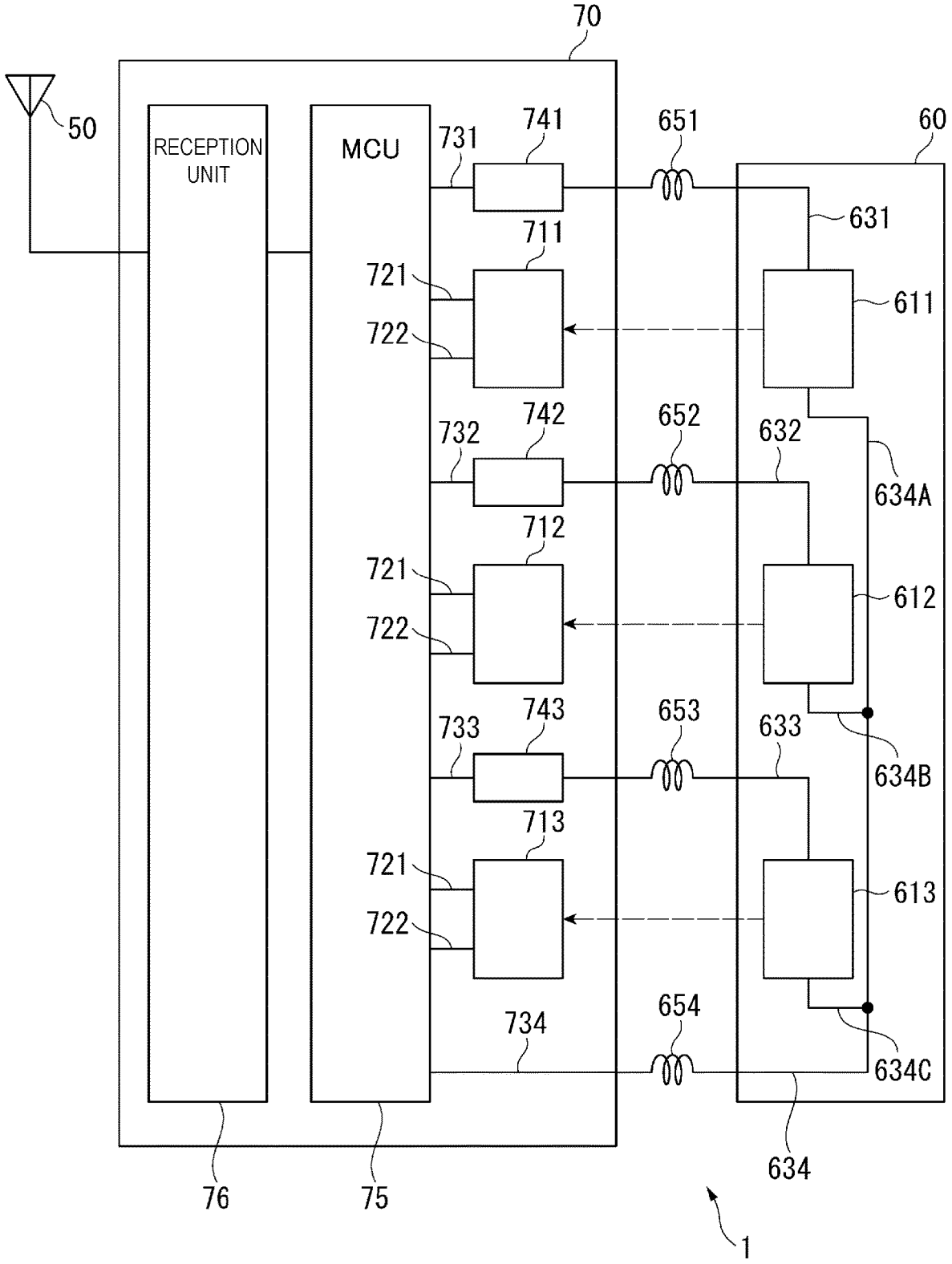
FIG. 6 is a circuit block diagram illustrating a main part of the LED substrate and the printed wired board of the electronic watch.

As illustrated also in FIG. 6, the printed wired board 70 is mounted with an MCU (Micro Controller Unit) 75, and a reception unit 76.

The MCU 75 is a control unit that controls operation of the electronic watch 1, and controls hand movement control processing for operating each of the step motors 231 to 234, hand position detection processing for operating the light-emitting elements 611 to 613 and the light-receiving elements 711 to 713, satellite signal reception processing for operating the reception unit 76, and the like.

The reception unit 76 is composed of a reception IC and the like, and uses the planar antenna 50 to perform reception processing of a satellite signal.

The printed wired board 70 is provided with wiring lines 721 that supply, via the MCU 75, the power supply voltage VSS with low potential to the light-receiving elements 711, 712, and 713 respectively, and wiring lines 722 that supply the power supply voltage VDD with high potential that is the ground potential.

The printed wired board 70 is provided with a plurality of, specifically three number of, first wiring lines 731, 732, and 733 that supply, via MCU 75, the power supply voltage VSS to the LED substrate 60, and single second wiring line 734 that supplies the power supply voltage VDD, that is, the ground potential.

Thus, the MCU 75 can control each of the light-emitting elements 611 to 613 and the light-receiving elements 711 to 713 to individually turn on or off.

The circuit elements 741, 742, and 743 are coupled in series halfway the first wiring lines 731, 732, and 733, respectively. The circuit element 741 is a circuit element that increases electrical resistance when an alternating current generated by a radio wave received by the planar antenna 50 flows in the first wiring line 731, as compared to electrical resistance when a direct current flows in the first wiring line 731, the circuit element 742 is a circuit element that increases electrical resistance when an alternating current generated by a radio wave received by the planar antenna 50 flows in the first wiring line 732, as compared to electrical resistance when a direct current flows in the first wiring line 732, and the circuit element 743 is a circuit element that increases electrical resistance when an alternating current generated by a radio wave received by the planar antenna 50 flows in the first wiring line 733, as compared to electrical resistance when a direct current flows in the first wiring line 733, and in the present exemplary embodiment, chipped ferrite beads are used. Each of the circuit elements 741, 742, and 743 formed of the ferrite bead functions as a low pass filter that reduces a high-frequency component. A reason for providing these circuit elements 741, 742, and 743 is as follows. According to analysis by the present inventors, it was found that, when the LED substrate 60 and the printed wired board 70 were conducted to each other with a conduction member such as a coil spring described below, and while a high frequency signal such as a satellite signal was received by an antenna, a current was induced in a direction that cancels a current of the antenna by a resonant phenomenon in the circuit conducted with the coil spring, and sensitivity of the antenna that receives a radio wave deteriorated. Thus, in order to suppress the induction of the current in the direction that cancels the current of the antenna, and to improve reception sensitivity of the antenna, compared to a case where a circuit element is not provided, the circuit elements 741, 742, and 743 such as ferrite beads are coupled that increases, compared to electrical resistance when a direct current flows in the wiring line, electrical resistance when an alternating current generated by a radio wave received by the antenna flows in the wiring line.

Note that, in the present exemplary embodiment, a circuit element formed of a ferrite bead is not coupled to the second wiring line 734 that supplies the power supply voltage VDD, but a circuit element may also be coupled in series halfway the second wiring line 734.

The LED substrate 60 is provided with three third wiring lines 631, 632, and 633 that individually supply the power supply voltage VSS to the light-emitting elements 611, 612, and 613, respectively, and fourth wiring line 634 that supplies the power supply voltage VDD to the light-emitting elements 611, 612, and 613. The fourth wiring line 634 branches into three wiring lines 634A, 634B, and 634C that are coupled to the light-emitting elements 611, 612, and 613, respectively.

The third wiring line 631 of the LED substrate 60 is electrically coupled to the first wiring line 731 of the printed wired board 70 with the first conduction member 651, the third wiring line 632 of the LED substrate 60 is electrically coupled to the first wiring line 732 of the printed wired board 70 with the first conduction member 652, and the third wiring line 633 of the LED substrate 60 is electrically coupled to the first wiring line 733 of the printed wired board 70 with the first conduction member 653. Further, the fourth wiring line 634 of the LED substrate 60 is electrically coupled to the second wiring line 734 of the printed wired board 70 with the second conduction member 654. The first conduction members 651, 652, and 653 and the second conduction member 654 are each constituted by a coil spring.

As illustrated in FIG. 3, the secondary battery 24 is a button shaped lithium ion battery formed in a planar circular shape, and is disposed in a cutout portion 71 of the printed wired board 70 illustrated in FIG. 5.

The solar cell panel 25 is a solar cell panel used for a wrist watch, for example, for which a film-type solar cell in which an amorphous silicon film is stacked on a resin film substrate can be used. Two electrode terminals are provided on the solar cell panel 25, and the electrode terminals are conducted to the printed wired board 70 with coil springs 251 and 252, respectively, as illustrated in FIG. 4. Thus, a current generated by the solar cell panel 25 is charged to the secondary battery 24 via the coil springs 251, 252, and the printed wired board 70.

Planar Antenna

The planar antenna 50 is disposed between the main plate 21 and the solar cell panel 25. The planar antenna 50 is an antenna that receives a satellite signal from a GPS satellite, and is configured with a planar inverted F-shaped antenna in the present exemplary embodiment.

As illustrated in FIGS. 3 and 4, the planar antenna 50 includes a dielectric substrate 51 made of a synthetic resin to be an antenna substrate. On a front surface of the dielectric substrate 51, that is, a surface on a side of the solar cell panel 25, a first electrode 52 to be an antenna electrode is stacked on a substantially entire surface thereof.

Protruding portions are formed at a back surface of the dielectric substrate 51, that is, on a surface on a side of the main plate 21. The protruding portions include an inner circumferential side protruding portion 51A formed at a position on an inner circumferential side of the date indicator 5 in plan view, and an outer circumferential side protruding portion 51B formed at a position on an outer circumferential side of the date indicator 5. A recessed portion 51C in which the LED substrate 60 is disposed is formed in the inner circumferential side protrusion 51A, and a second electrode 53 is stacked on a lowermost surface of the inner circumferential side protruding portion 51A excluding this recessed portion 51C. Furthermore, the second electrode 53 is also stacked on a lowermost surface of the outer circumferential side protruding portion 51B.

A short-circuit portion 54 that short-circuits the first electrode 52 to the second electrode 53 is stacked on a side surface of the dielectric substrate 51.

Furthermore, a power supply terminal 55 is formed at the outer circumferential side protruding portion 51B so as to be spaced from the second electrode 53. The power supply terminal 55 is conducted to the first electrode 52 via the side surface of the dielectric substrate 51.

One end of a power supply pin 56 abuts on the power supply terminal 55. Another end of the power supply pin 56 abuts on the printed wired board 70, and the power supply voltage VDD is supplied from the printed wired board 70 to the planar antenna 50 via the power supply pin 56.

The second electrode 53 of the planar antenna 50 contacts the hour wheel holder 26 made of metal. The hour wheel holder 26 also serves as a ground member of the planar antenna 50. In addition, since the hour wheel holder 26 is made of metal, the hour wheel holder 26 also serves as a magnetic shield plate covering a side of the dial 2 of each of the step motors 231 to 234.

The planar antenna 50 also serves as a support substrate that supports the solar cell panel 25 formed of a film.

In addition, in the present exemplary embodiment, the LED substrate 60 that is the first substrate, is disposed in the recessed portion 51C of the dielectric substrate 51 that is the antenna substrate. Thus, the dielectric substrate 51 overlaps at least partially with the LED substrate 60, the first conduction members 651, 652, 653, and the second conduction member 654 that contact the LED substrate 60, in a side view viewed from a direction orthogonal to the thickness direction of the electronic watch 1. That is, the dielectric substrate 51 and the LED substrate 60 are disposed at respective height positions substantially identical to each other in the thickness direction of the electronic watch 1.

In addition, since the LED substrate 60 is disposed in the recessed portion 51C, the planar antenna 50 and the LED substrate 60 are disposed so as to overlap at least partially with each other in plan view viewed from the thickness direction of the electronic watch 1. In the present exemplary embodiment, in plan view, an entirety of the LED substrate 60 is disposed on the planar antenna 50 in an overlapping manner.

Hand Position Detection Processing

The MCU 75 controls the step motors 231, 232, and 233 to drive the hour hand 31, the minute hand 32, and the seconds hand 33 respectively, and drives the light-emitting elements 611, 612, 613, the light-receiving elements 711, 712, and 713, at a time that the hour hand 31, the minute hand 32, and the seconds hand 33 point the graduation of 12 o'clock, that is, when it's 0:0:0 or 12:0:0.

Accordingly, the MCU 75 can detect whether or not light emitted by the light-emitting element 611 can be received by the light-receiving element 711 via the through holes in the main plate 21 and the train wheel, whether or not light emitted by the light-emitting element 612 can be received by the light-receiving element 712 via the through holes in the main plate 21 and the train wheel, and whether or not light emitted by the light-emitting element 613 can be received by the light-receiving element 713 via the through holes in the main plate 21 and the train wheel. Then, when the light of the light-emitting element 611 can be received by the light-receiving elements 711, the light of the light-emitting element 612 can be received by the light-receiving elements 712, the light of the light-emitting element 613 can be received by the light-receiving elements 713, the MCU 75 can confirm that the hour hand 31, the minute hand 32, and the seconds hand 33 point the graduation of 12 o'clock. On the other hand, when light of the light-emitting elements 611 cannot be received by the light-receiving elements 711, light of the light-emitting elements 612 cannot be received by the light-receiving elements 712, and light of the light-emitting elements 613 cannot be received by the light-receiving elements 713, the hour hand 31, the minute hand 32, and the seconds hand 33 point incorrectly, the MCU 75 moves each of the step motors 231, 232, and 233 by one step at a time, while driving the light-emitting elements 611, 612, 613, the light-receiving elements 711, 712, and 713, to detect hand positions at which the hour hand 31, the minute hand 32, and the seconds hand 33 point the graduation of 12 o'clock respectively. At this time, since the respective hand positions of the hour hand 31 and the seconds hand 33 can be individually detected, it is sufficient that, after the first step motor 231 and the third step motor 233 are driven to detect that the hour 31 and the seconds hand 33 point the graduation of 12 o'clock, the second step motor 232 is driven to detect that the minute hand 32 points the graduation of 12 o'clock.

Furthermore, each of the circuit elements 741, 742, and 743 functions as a low pass filter, and DC resistance is as small as approximately 2Ω, so light emission of the light-emitting elements 611, 612, and 613 are not affected.

Reception Processing

When reception processing is started by the manual reception function or the automatic reception function, the MCU 75 drives the reception unit 76 to receive a satellite signal by the planar antenna 50. At this time, the circuit element 741 formed of the ferrite bead is coupled in series to the first wiring line 731 on a line that is conducted to the LED substrate 60, the circuit element 742 formed of the ferrite bead is coupled in series to the first wiring line 732 on a line that is conducted to the LED substrate 60, and the circuit element 743 formed of the ferrite bead is coupled in series to the first wiring line 733 on a line that is conducted to the LED substrate 60, thus it is possible to suppress induction of a current in a direction that cancels a current flowing in the planar antenna 50 by receiving a satellite signal, and reception sensitivity of the planar antenna 50 can be improved, compared to a case in which the circuit elements are not provided.

Advantageous Effects of First Exemplary Embodiment

According to the electronic watch 1 of the present exemplary embodiment, the circuit elements 741, 742, and 743 are coupled in series halfway the first wiring lines 731, 732, and 733 respectively that supply the power supply voltage VSS to the LED substrate 60, the reception sensitivity of the planar antenna 50 can be improved, compared to a case where the circuit elements 741, 742, and 743 are not provided. For example, by performing an experiment using the electronic watch 1 of the first exemplary embodiment, when the circuit elements 741, 742, and 743 were provided, it was possible to improve an antenna gain by approximately 1.6 dB, compared to a case where the circuit elements 741, 742, and 743 were not provided.

In addition, since each of the circuit elements 741, 742, and 743 is a circuit element for which electrical resistance increases when an alternating current flows, in comparison to a case where a direct current flows, thus, it is possible to cause the light-emitting elements 611, 612, and 613 to emit light without being affected by the circuit elements 741, 742, and 743. In other words, when direct currents are caused to flow in the first wiring lines 731, 732, and 733 to drive the light-emitting 611, 612, and 613, respectively, each of the circuit elements 741, 742, and 742 has a small resistance value for the direct current, thus the current flowing in each of the light-emitting element 611, 612, and 613 is hardly reduced. Accordingly, intensity of light emitted from each of the light-emitting elements 611, 612, and 613 is also hardly reduced, thus it is also possible to maintain a position of the through hole of the gear, that is, detection accuracy of the hand position.

Since the first conduction members 651, 652, 653 and the second conduction member 654 are each constituted by the coil spring, by disposing the first conduction members 651, 652, 653, and the second conduction member 654 between the LED substrate 60 and the printed wired board 70, it is possible to reliably conduct the LED substrate 60 to the printed wired board 70. Thus, an assembly operation of the electronic watch 1 can be made efficient.

Furthermore, when the first conduction members 651, 652, and 653 are each constituted by the coil spring, an effect of an alternating current generated by a radio wave received by the planar antenna 50 increases, however, since the first wiring lines 731, 732, and 733 are provided with the circuit elements 741, 742, and 743, respectively, the effect of the alternating current can be suppressed, and reduction in the reception sensitivity of the planar antenna 50 can be suppressed.

The LED substrate 60 includes the three light-emitting elements 611, 612, 613, the three third wiring lines 631, 632, 633, and one number of the fourth wiring line 634, and the printed wired board 70 includes the first wiring lines 731, 732, 733 and the single second wiring 734. The fourth wiring line 634 branches and is electrically coupled to each of the light-emitting elements 611, 612, and 613. Thus, the three light-emitting elements 611, 612, and 613 can be operated individually, and the number of wiring lines provided on the LED substrate 60 and the printed wired board 70 can be minimized.

The dielectric substrate 51 of the planar antenna 50 also serves as components of the movement 20 such as the recessed portion 51C for housing the LED substrate 60, a date indicator maintaining plate that holds down the date indicator 5, and the support substrate of the solar cell panel 25, thus a degree of freedom of movement design is improved, which is advantageous for reducing in size and thickness of the electronic watch 1.

In addition, since the hour wheel holder 26 also serves as a ground member of the planar antenna 50 and the magnetic shield plate, the degree of freedom of the movement design is further improved, which is advantageous for reducing in size and thickness of the electronic watch 1.

Since the LED substrate 60 is housed in the recessed portion 51C of the dielectric substrate 51, and is disposed at a height position substantially identical to that of the dielectric substrate 51, a thickness dimension of the movement 20 can be reduced and the electronic watch 1 can be thinned.

In addition, when the dielectric substrate 51 and the LED substrate 60 are disposed at respective height positions substantially identical to each other, the first conduction members 651, 652, and 653, such as the coil spring, easily affect the reception sensitivity of the antenna during the reception processing of a satellite signal, however, since the circuit elements 741, 742, and 743 are coupled in series to the first wiring lines 731, 732, and 733, respectively, effects by the first conduction members 651, 652, and 653 can be reduced, and the reception sensitivity of the planar antenna 50 can be improved.

Since the LED substrate 60 overlaps with the planar antenna 50 in plan view, a planar size of the planar antenna 50 can be increased in the case main body 11 of the electronic watch 1, and the reception sensitivity can be improved.

Since each of the circuit elements 741, 742, and 743 is constituted by the ferrite bead, compared to a case where a low pass filter is formed of a plurality of elements, a low pass filter can be formed of one element, thus the circuit element can be made smaller and a resistance component for an alternating current can be increased.

Since the solar cell panel 25 is disposed on an entire surface on a front surface side of the planar antenna 50, a power generation area can be increased.

Second Exemplary Embodiment

Figure 7:
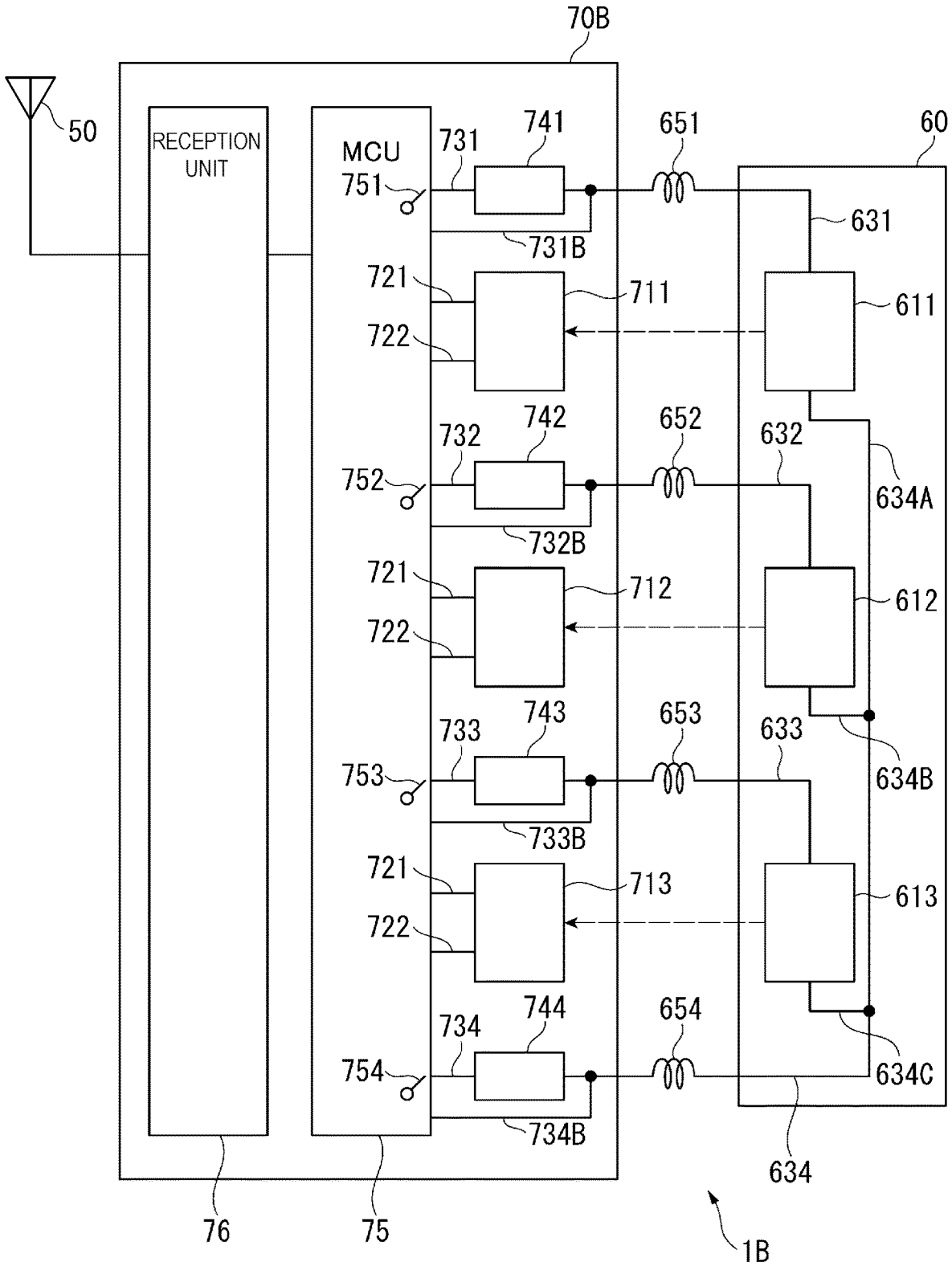
FIG. 7 is a circuit block diagram illustrating a main part of an LED substrate and a printed wired board of an electronic watch of a second exemplary embodiment.

Next, an electronic watch 1B of a second exemplary embodiment illustrated in FIG. 7 will be described. A configuration of a printed wired board 70B of the electronic watch 1B of the second exemplary embodiment differs from that of the printed wired board 70 of the first exemplary embodiment, and other configurations and effects are identical to those of the first exemplary embodiment, and thus descriptions thereof will be omitted.

The printed wired board 70B is different from the printed wired board 70 of the first exemplary embodiment in that, a bypass wiring line 731B coupled in parallel to the first wiring line 731 to bypass the circuit element 741, a bypass wiring line 732B coupled in parallel to the first wiring line 732 to bypass the circuit element 742, a bypass wiring line 733B coupled in parallel to the first wiring line 733 to bypass the circuit element 743, a switch 751 that switches between the first wiring line 731 and the bypass wiring line 731B, a switch 752 that switches between the first wiring line 732 and the bypass wiring line 732B, and a switch 753 that switches between the first wiring line 733 and the bypass wiring line 733B are provided.

The switches 751, 752, and 753 are each constituted by a switch element, such as a transistor incorporated into the MCU 75, and are each coupled to a power supply line of the MCU 75.

The bypass wiring line 731B branches between the circuit element 741 of the first wiring line 731 and the first conduction member 651, and couples to a terminal switched by the switch 751, the bypass wiring line 732B branches between the circuit element 742 of the first wiring line 732 and the first conduction member 652, and couples to a terminal switched by the switch 752, and the bypass wiring line 733B branches between the circuit element 743 of the first wiring line 733 and the first conduction member 653, and couples to a terminal switched by the switch 753.

Thus, as a power supply path to the light-emitting elements 611, 612, and 613 from a power source supplying the power supply voltage VSS to the light-emitting elements 611, 612, and 613 that are each the first element, the switch 751 is a switch that can select from a first path via the first wiring line 731 to which the circuit element 741 is coupled in series, and a second path via the bypass wiring line 731B, the switch 752 is a switch that can select from a first path via the first wiring line 732 to which the circuit element 742 is coupled in series, and a second path via the bypass wiring line 732B, and the switch 753 is a switch that can select from a first path via the first wiring line 733 to which the circuit element 743 is coupled in series, and a second path via the bypass wiring line 733B.

Further, the printed wired board 70B includes, halfway the second wiring line 734 as well, a bypass wiring line 734B to which the circuit element 744 is coupled in series and that bypasses the circuit elements 744, and a switch 754 that switches between the second wiring line 734 and the bypass wiring line 734B.

Thus, the switch 754 is a switch that can select from, as a power supply path to the light-emitting elements 611, 612, and 613 from the power source supplying the power supply voltage VDD to the light-emitting elements 611, 612, and 613 that are each the first element, a first path via the second wiring line 734 to which the circuit element 744 is coupled in series, and a second path via the bypass wiring line 734B.

Advantageous Effects of Second Exemplary Embodiment

While controlling the reception unit 76 to perform reception processing in the planar antenna 50, the MCU 75 couples, the switch 751 to the first wiring line 731 to which the circuit element 741 is coupled in series to select the first path, the switch 752 to the first wiring line 732 to which the circuit element 742 is coupled in series to select the first path, the switch 753 to the first wiring line 733 to which the circuit element 743 is coupled in series to select the first path, the switch 754 to the second wiring line 734 to which the circuit element 744 is coupled in series to select the first path. Thus, while the reception processing in the planar antenna 50 is performed, action is similar to that in the first exemplary embodiment, and the sensitivity of the planar antenna 50 can be improved, compared to a case where the circuit elements are not provided.

In particular, in the second exemplary embodiment, in addition to the first wiring lines 731, 732, and 733, the circuit element 744 is also coupled in series to the second wiring line 734, thus an effect of an alternating current generated by a radio wave received by the planar antenna 50 can be further suppressed, and the reception sensitivity of the planar antenna 50 can be further improved.

The MCU 75, while the reception processing is not performed in the planar antenna 50, couples the switches 751, 752, 753, and 754 to the bypass wiring lines 731B, 732B, 733B, and 734B, respectively. Thus, when the hand position detection processing is performed in other than a reception processing period, currents can be supplied without passing through the circuit elements 741, 742, 743, and 744, and thus, currents flowing in the light-emitting elements 611, 612, and 613 do not decrease, and it is possible to prevent light intensity of the light-emitting elements 611, 612, and 613 from decreasing. Thus, during the hand position detection processing, light intensity of the light-emitting elements 611, 612, and 613 do not decrease, and hand position detection accuracy can be improved.

Third Exemplary Embodiment

Figure 8:
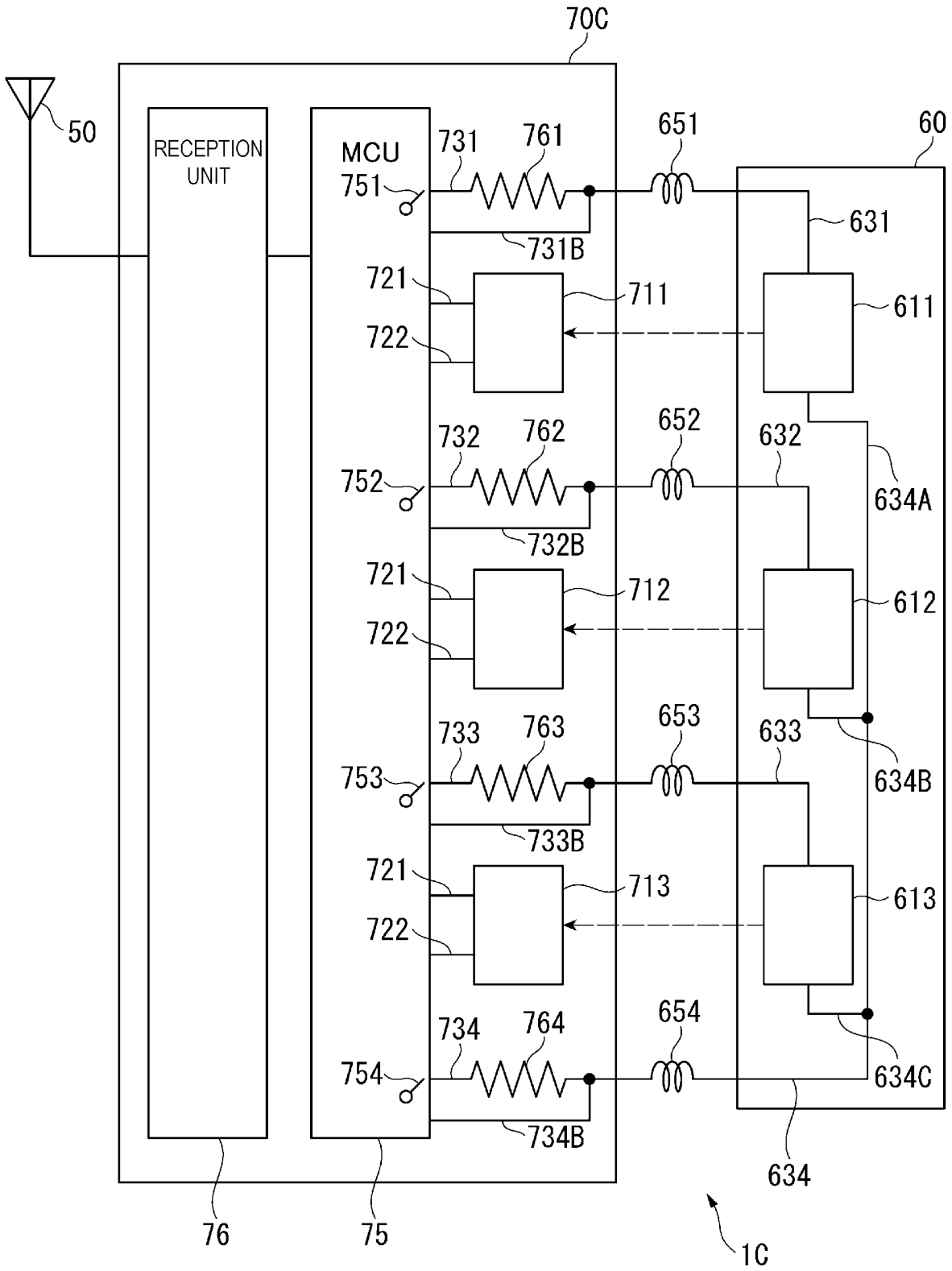
FIG. 8 is a circuit block diagram illustrating a main part of an LED substrate and a printed wired board of an electronic watch of a third exemplary embodiment.

Next, an electronic watch 1C of a third exemplary embodiment illustrated in FIG. 8 will be described. A configuration of a printed wired board 70C of the electronic watch 10 of the third exemplary embodiment differs from that of the printed wired board 70B of the second exemplary embodiment, and other configurations and effects are identical to those of the second exemplary embodiment, and thus descriptions thereof will be omitted.

The printed wired board 70C is provided with resistive elements 761, 762, 763, and 764 in place of the circuit elements 741, 742, 743, and 744 of the printed wired board 70B. In other words, the resistive elements 761, 762, 763, and 764 are coupled in series to the first wiring lines 731, 732, 733, and the second wiring line 734 of the printed wired board 70C, respectively.

Advantageous Effects of Third Exemplary Embodiment

While controlling the reception unit 76 to perform the reception processing in the planar antenna 50, the MCU 75 couples, the switch 751 to the first wiring line 731 to which the resistive element 761 is coupled in series to select the first path, the switch 752 to the first wiring line 732 to which the resistive element 762 is coupled in series to select the first path, the switch 753 to the first wiring line 733 to which the resistive element 763 is coupled in series to select the first path, the switch 754 to the second wiring line 734 to which the resistive element 764 is coupled in series to select the first path. Thus, while the reception processing in the planar antenna 50 is performed, action is similar to that in the second exemplary embodiment, and the sensitivity of the planar antenna 50 can be improved, compared to a case where the resistive elements are not provided.

The MCU 75, while the reception processing is not performed in the planar antenna 50, couples the switches 751, 752, 753, and 754 to the bypass wiring lines 731B, 732B, 733B, and 734B, respectively. Thus, when hand position detection processing is performed in other than the reception processing period, currents flow in the light-emitting elements 611, 612, and 613 without passing through the resistive elements 761, 762, 763, and 764, and thus it is possible to prevent light intensity of the light-emitting elements 611, 612, and 613 from decreasing. Thus, during the hand position detection processing, light intensity of the light-emitting elements 611, 612, and 613 do not decrease, and hand position detection accuracy can be improved.

Note that, the MCU 75 controls such that automatic reception processing for performing the reception processing at a predetermined time, and the hand position detection processing performed at a determined time are not performed simultaneously. On the other hand, while the hand position detection processing is performed, when the user operates a button or the like to instruct to perform the manual reception processing, the MCU 75 may interrupt the hand position detection processing to start the manual reception processing, or the hand position detection processing may be prioritized to start the manual reception processing after the hand position detection process finishes. Furthermore, depending on a state of the electronic watch 1C, for example, on a progress state of the hand position detection processing, which of the manual reception processing and the hand position detection processing is prioritized may be selected.

Since, in the electronic watch 1C, the resistive elements 761, 762, 763, and 764 are used that are inexpensive compared to ferrite beads, a cost can be reduced, compared to a case where ferrite beads are used.

Other Exemplary Embodiments

Note that, the present disclosure is not limited to the exemplary embodiments described above, and various modifications are possible within the scope of the present disclosure.

In the first exemplary embodiment, a circuit element is not coupled to the second wiring line 734, but similar to the second exemplary embodiment, the circuit element 744 may be coupled in series to the second wiring line 734.

On the other hand, in each of the second and third exemplary embodiments, similar to the first exemplary embodiment, a configuration may be adopted in which the circuit element 744 or the resistive element 764 is not coupled to the second wiring line 734, and the bypass wiring line 734B or the switch 754 is also not provided.

Furthermore, when an effect on the reception sensitivity of the planar antenna 50 of the second wiring line 734 is large, and effects of the first wiring lines 731, 732, and 733 are small, a circuit element may be provided in the second wiring line 734 without coupling a circuit element to each of the first wiring lines 731, 732, and 733.

In the exemplary embodiments described above, the light-emitting elements 611, 612, and 613 are mounted on the LED substrate 60, that is the first substrate, and the light-receiving elements 711, 712, and 713 are mounted on each of the printed wired boards 70 and 70B, that are each the second substrate, but conversely, the light-receiving elements 711, 712, and 713 may be mounted on the LED substrate 60, that is the first substrate, and the light-emitting elements 611, 612, and 613 may be mounted on each of the printed wired boards 70 and 70B, that are each the second substrate.

In addition, in the exemplary embodiments described above, each of the printed wired boards 70, 70B, and 70C at which the MCU 75 is mounted is used as the second substrate, the circuit elements 741, 742, 743, and 744 are mounted, but each of the printed wired boards 70, 70B, and 70C may be used as the first substrate, and the LED substrate 60 is used as the second substrate, to couple circuit elements or resistive elements in series to the third wiring lines 631, 632, 633, and the fourth wiring line 634 of the LED substrate 60, or to provide a bypass wiring line or a switch on the LED substrate 60.

Furthermore, each of the first conduction members 651, 652, 653, and the second conduction member 654 is not limited to the coil spring, and may be a conduction pin, a conductive connector, or the like, and any member may be used as far as the member can conduct each the wiring line. However, when the coil spring is used, the reception sensitivity of the antenna is easily affected, so an advantage of providing the circuit elements 741, 742, 743, and 744 is large.

In each of the exemplary embodiments described above, the circuit element 741 is coupled in series to the first wiring line 731 that drives the light-emitting element 611 that detects the hand position of the hour hand 31, the circuit element 742 is coupled in series to the first wiring line 732 that drives the light-emitting element 612 that detects the hand position of the minute hand 32, the circuit element 743 is coupled in series to the first wiring line 733 that drives the light-emitting element 613 that detects the hand position of the seconds hand 33, and the circuit element 744 is coupled in series to the second wiring line 734, but a circuit element or a resistive element may be coupled in series to a wiring line that drives a light-emitting element and a light-receiving element that detect a rotational position of the date indicator 5, and further, a bypass wiring line or a switch may be provided as appropriate.

Furthermore, a city name indicating a time zone and the like may be designated on the dial ring 14 or the bezel 112, and when a pointer to point this city name designation is provided, a circuit element or resistive element may be coupled in series to a wiring line that drives a light-emitting element and a light-receiving element that detect a position pointed by this pointer, and further a bypass wiring line or a switch may be provided as appropriate.

The control of selection from the first path and the second path by switching control of the MCU 75 in the electronic watch 1B is not limited to the example of the second exemplary embodiment.

For example, the MCU 75, while driving the light-emitting elements 611, 612, and 613 that are each the first element, that is, during the hand position detection processing, may couple the switches 751, 752, 753, and 754 to the bypass wiring lines 731B, 732B, 733B, and 734B, respectively, to select each the second path, and in periods other than that, may couple the switches 751, 752, 753, and 754 to the first wiring lines 731, 732, 733, and the second wiring line 734, respectively, to select each the first path. Additionally, during the hand position detection processing, the MCU 75 prohibits performance of reception control of a satellite signal by the planar antenna 50.

In this case, when the light-emitting elements 611, 612, and 613 are driven, the second path is certainly selected, so loss of a current in each of the circuit elements 741, 742, 743, and 744 can be eliminated. Thus, when the hand position detection processing is performed, light intensity of the light-emitting elements 611, 612, and 613 can be prevented from reducing, and the hand position detection accuracy can be improved.

Furthermore, the circuit element that increases electrical resistance when an alternating current generated by a radio wave received by the antenna flows in the wiring line, compared to electrical resistance when a direct current flows in the wiring line, is not limited to the ferrite bead, and a low pass filter using an inductor and a capacitor may also be used. Furthermore, as in the second exemplary embodiment, when the wiring line paths can be switched, the circuit element may be a low pass filter using a capacitor and a resistive element.

The second substrate may be constituted by two substrates, that is, a wiring substrate provided with a first wiring line and a second wiring line for supplying power to a first element of a first substrate, and an element substrate mounted with a second element. In other words, it is sufficient that the second substrate is provided with the first wiring line and the second wiring line that supply power to at least the first element of the first substrate. Furthermore, when a conductive member such as a coil spring that conducts the wiring substrate to the element substrate is provided, a configuration similar to that of the above-described exemplary embodiments may be provided in a wiring line that is electrically coupled by this conduction member.

As an antenna that is incorporated into each of the electronic watches 1, 1B, and 1C is not limited to the planar antenna 50 formed of the planar inverted F-shaped antenna, and different types of antennas such as patch antennas and ring antennas may be used.

When a patch antenna is used, a size of plan view is small, thus it is possible to dispose the antenna at a position that does not overlap with a secondary battery, a step motor, a train wheel, and the like, in plan view. That is, the patch antenna can be disposed between the main plate 21 and the printed wired board 70 of the movement 20, which is advantageous for reducing in size and thickness of each of the electronic watches 1, 1B, and 1C. Also, since the patch antenna is easy to maintain required reception sensitivity even when a bezel is made of metal, it is not necessary to limit a material of the bezel to ceramic or the like, and it is possible to realize the electronic watches 1, 1B, and 1C using metal edge design.

Further, when a ring antenna is used, the ring antenna is disposed along an outer periphery of the dial 2, so the antenna is disposed closer to a front surface side than the movement 20, that is, on a side of the cover glass 13, which makes it difficult to be affected by a watch component such as a step motor, and thus reception performance can be improved.

In each of the exemplary embodiments described above, the antenna receives a satellite signal transmitted from a GPS satellite, but a signal received by the antenna is not limited thereto. For example, satellite signals transmitted from various satellites may be received, such as, for example, other global navigation satellite systems (GNSS) such as Galileo, GLONASS, and Beidou, satellite-based augmentation systems (SBAS), and regional navigation satellite systems (RNSS) that can search for only in certain regions, such as a quasi-zenith satellite.

Further, the antenna is not limited to an antenna that receives a satellite signal, and, for example, an antenna may be used that receives other radio waves such as Bluetooth (registered trademark), Bluetooth Low Energy (BLE), Wi-Fi, Near Field Communication (NFC), Low Power Wide Area (WLAN), and the like. That is, as an antenna incorporated in each of the electronic watches 1, 1B, and 1C, it is sufficient to use an appropriate antenna depending on a type of signal to be received, a size of the watch, whether the antenna fits into the watch together with other components, and the like.

While the above exemplary embodiments illustrate the electronic watch with the time display unit of analog type that uses the dial and the plurality of pointers to display a time and the like, but the electronic watch is not limited to one that includes only an analog type time display unit. For example, an electronic watch may be configured with both a digital type time display unit that uses a liquid crystal display unit or the like to display a time and the like, and an analog type time display unit.

Summary

An electronic watch of the present disclosure includes a time display unit configured to display a time, an antenna configured to receive a radio wave, a first substrate at which a first element that is one of a light-emitting element or a light-receiving element is mounted, a second substrate at which a second element that is the other of the light-emitting element or the light-receiving element disposed so as to be opposed to the first element is mounted, a gear including a through hole through which light emitted from the light-emitting element and received by the light-receiving element passes through, the gear being disposed between the first substrate and the second substrate, and a first conduction member and a second conduction member configured to electrically couple the first substrate to the second substrate, wherein the second substrate includes a first wiring line electrically coupled to the first substrate via the first conduction member, and a second wiring line electrically coupled to the first substrate via the second conduction member, and a circuit element is coupled in series halfway at least one wiring line of the first wiring line and the second wiring line that, compared to electrical resistance when a direct current flows in the wiring line, increases electrical resistance when an alternating current generated by the radio wave received by the antenna flows in the wiring line.

According to the electronic watch of the present disclosure, the second substrate is provided with the first wiring line and the second wiring line that are electrically coupled to the first substrate via the first conduction member and the second conduction member, and the circuit element is coupled in series halfway at least one wiring line of these wiring lines. The circuit element is a circuit element that increases electrical resistance when an alternating current generated by a radio wave received by the antenna flows in the wiring line, in comparison to electrical resistance when a direct current flows in the wiring line, and thus during reception of a high-frequency signal such as a satellite signal by the antenna, it is possible to suppress induction of a current in a direction that cancels a current of the antenna by a resonant phenomenon in a circuit conducted with a conduction member, and to improve reception sensitivity of the antenna. Furthermore, since the circuit element can reduce the electrical resistance when the direct current flows, the circuit element can drive the first element without being affected by the circuit element, when the direct current is caused to flow in the wiring line in order to drive the first element.

In the electronic watch, the first conduction member and the second conduction member are each constituted by a coil spring.

When the conduction member is constituted by the coil spring, by disposing a coil spring between the first substrate and the second substrate, the coil spring can press and contact each of the substrates to reliably conduct the substrates to each other. Thus, an assembly operation of the electronic watch can be streamlined. Furthermore, when the conduction member is constituted by the coil spring, an effect of an alternating current generated by a radio wave received by the antenna is increased, however, since wiring line is provided with the circuit element, the effects of the alternating current can be suppressed, and reduction in the received sensitivity of the antenna can also be suppressed.

In the electronic watch, the first substrate includes a plurality of the first elements, a plurality of third wiring lines individually and electrically coupled to the plurality of first elements, and a fourth wiring line that branches and is electrically coupled to the plurality of first elements, the second substrate includes a plurality of the second elements, a plurality of the first wiring lines are provided corresponding to the plurality of first elements, one number of the second wiring line is provided, a plurality of the first conduction members are provided so as to electrically couple the first wiring line to the third wiring line, the second conduction member electrically couples the second wiring line to the fourth wiring line, and a plurality of the circuit elements are provided and coupled in series halfway the plurality of first wiring lines respectively.

When the plurality of first elements and second elements are provided, since the third wiring line that is individually coupled to each the first element and the fourth wiring line that branches and is electrically coupled to each the first element are provided, each the first element can be individually operated, and the number of wiring lines provided on the first substrate can be minimized.

Furthermore, it is sufficient that the first wiring line and the second wiring line of the second substrate, the first conduction member, and the second conduction member may also be provided corresponding to the third wiring line and the fourth wiring line, and thus, the number thereof can be set to a minimum number.

In the electronic watch, the circuit element is also coupled in series halfway the second wiring line.

Since, in addition to the first wiring line, the circuit element is also coupled in series to the second wiring line, the effect of an alternating current generated by a radio wave received by the antenna can be further suppressed, and the reception sensitivity of the antenna can be further improved.

In the electronic watch, the second substrate includes, of the first wiring line and the second wiring line, a bypass wiring line that bypasses the wiring line to which the circuit element is coupled in series halfway the wiring line, and a switch that can select from, as a power supply path from a power source to the first element for supplying power to the first element, a first path via a wiring line to which the circuit element is coupled in series, and a second path via the bypass wiring line, and a control unit is included that, while the radio wave is received by the antenna, controls the switch to select the first path.

The control unit, while receiving a radio wave by the antenna, selects, by the switch, the first path for supplying power via the wiring line to which the circuit element is coupled in series, and thus while receiving a high-frequency signal such as a satellite signal by the antenna, it is possible to suppress induction of a current in a direction that cancels a current of the antenna by a resonant phenomenon in a circuit conducted with a conduction member, and the reception sensitivity of the antenna can be improved, compared to a case where the second path not passing through the circuit element is selected.

In the electronic watch, the control unit, while receiving the radio wave by the antenna, controls the switch to select the first path, and in a period during which the radio wave is not received by the antenna, controls the switch to select the second path.

In a period in which a radio wave is not received by the antenna, the control unit selects the second path by the switch, thus when the first element is driven in the period in which a radio wave is not received by the antenna, loss of a current caused by the circuit element can be eliminated, and deterioration in hand position detection accuracy can be prevented.

In the electronic watch, the control unit, while the first element is driven, controls the switch to select the second path, and in a period during which the first element is not driven, controls the switch to select the first path, and while the first element is driven, does not perform processing to receive the radio wave by the antenna.

While driving the first element, the control unit selects the second path by the switch, thus loss of a current due to the circuit element can be eliminated, and deterioration in the hand position detection accuracy can be prevented.

In addition, the control unit, in a period during which the first element is driven, selects the first path by the switch, and does not perform the reception process while the first element is driven. Thus, the control unit performs the reception processing in the period during which the first element is not driven, that is, in the period during which the first path is selected, so the reception sensitivity of the antenna can be improved.

In the electronic watch, the antenna includes the antenna substrate, and the antenna electrode, and any member of the first substrate, the first conduction member, and the second conduction member, and the antenna substrate overlap with each other at least partially in a side view viewed from a direction orthogonal to the thickness direction of the electronic watch. Since the antenna substrate, the first substrate, and the like are disposed so as to overlap with each other in a side view, that is, disposed at respective height positions substantially identical to each other in the thickness direction of the electronic watch, compared to a case where the antenna substrate, the first substrate, and the like are disposed so as not to overlap with each other in a side view, a thickness dimension of the movement can be reduced and the electronic watch can be thinned.

Moreover, when the antenna substrate, the first substrate, and the like are disposed at respective height positions substantially identical to each other, the conduction member such as the coil spring affects the reception sensitivity of the antenna upon reception of a radio wave, but the circuit element is coupled to the wiring line conducted to the conduction member, thus, the effect of the conduction member can be reduced, and the reception sensitivity of the antenna can be improved.

In the electronic watch, the antenna and the first substrate overlap with each other at least partially in plan view viewed from the thickness direction of the electronic watch.

Since the antenna and the first substrate overlap with each other in plan view, in the case of the electronic watch, a planar size of the antenna can be increased, and the reception sensitivity can be improved.

In the electronic watch, the circuit element is the ferrite bead.

Since the circuit element is the ferrite bead, compared to a case where a low pass filter is constituted by a plurality of elements, the circuit element can be realized by one element, thus the circuit element can be made smaller, and a resistance component for an alternating current can be increased.

An electronic watch of the present disclosure includes a time display unit configured to display a time, an antenna configured to receive a radio wave, a first substrate at which a first element that is one of a light-emitting element or a light-receiving element is mounted, a second substrate at which a second element that is the other of the light-emitting element or the light-receiving element disposed so as to be opposed to the first element is mounted, a gear including a through hole through which light emitted from the light-emitting element and received by the light-receiving element passes through, the gear being disposed between the first substrate and the second substrate, and a first conduction member and a second conduction member configured to electrically couple the first substrate to the second substrate, wherein the second substrate includes a first wiring line electrically coupled to the first substrate via the first conduction member, and a second wiring line electrically coupled to the first substrate via the second conduction member, a resistive element is coupled in series halfway at least one wiring line of the first wiring line and the second wiring line, of the first wiring line and the second wiring line, to the wiring line to which the resistive element is coupled in series halfway the wiring line, a bypass wiring line for bypassing the resistive element is coupled, a switch is provided that is configured to select from, as a power supply path from a power source to the first element for supplying power to the first element, a first path via the wiring line to which the resistive element is coupled in series, and a second path via the bypass wiring line, and a control unit is included that, while receiving the radio wave by the antenna, controls the switch to select the first path, and while driving the first element, controls the switch to select the second path.

According to the electronic watch of the present disclosure, the second substrate is provided with the first wiring line and the second wiring line that are electrically coupled to the first substrate via the first conduction member and the second conduction member, and the resistive element is coupled in series halfway at least one wiring line of these wiring lines. By coupling the resistive element in series to the circuit conducted by the conduction member, it is possible to suppress induction of a current in a direction that cancels a current of the antenna due to a resonant phenomenon. Accordingly, the control unit, while receiving a radio wave by the antenna, selects, by the switch, the first path through which power is supplied via a wiring line to which the circuit element is coupled in series, thus the reception sensitivity of the antenna can be improved. In addition, the control unit, while driving the first element, by the switch, supplies a current to the first element via the bypass wiring line, and the current does not pass through the resistive element, so a current value flowing in the first element is not reduced by the resistive element, and deterioration in hand position detection accuracy can be prevented.

What is claimed is:

1. An electronic watch, comprising:

a time display unit configured to display a time;

an antenna configured to receive a radio wave;

a first substrate at which a first element that is one of a light-emitting element or a light-receiving element is mounted;

a second substrate at which a second element that is the other of the light-emitting element or the light-receiving element disposed so as to be opposed to the first element is mounted;

a gear including a through hole through which light emitted from the light-emitting element and received by the light-receiving element passes through, the gear being disposed between the first substrate and the second substrate; and a first conduction member and a second conduction member configured to electrically couple the first substrate to the second substrate, wherein the second substrate includes a first wiring line electrically coupled to the first substrate via the first conduction member, and a second wiring line electrically coupled to the first substrate via the second conduction member, and a circuit element is coupled in series halfway in at least one wiring line of the first wiring line and the second wiring line, the circuit element being configured to increase electrical resistance when an alternating current generated by the radio wave received by the antenna flows in the wiring line compared to electrical resistance when a direct current flows in the wiring line.

2. The electronic watch according to claim 1, wherein the first conduction member and the second conduction member are each constituted by a coil spring.

3. The electronic watch according to claim 1, wherein the first substrate includes a plurality of the first elements, a plurality of third wiring lines individually and electrically coupled to the plurality of first elements, and a fourth wiring line that branches and is electrically coupled to the plurality of first elements, and wherein the second substrate includes a plurality of the second elements, a plurality of the first wiring lines are provided corresponding to the plurality of first elements, a plurality of the first conduction members are provided so as to electrically couple the first wiring line to the third wiring line, the second conduction member electrically couples the second wiring line to the fourth wiring line, and a plurality of the circuit elements are provided, and coupled in series halfway in the plurality of first wiring lines respectively.

4. The electronic watch according to claim 3, wherein the circuit element is also coupled in series halfway in the second wiring line.

5. The electronic watch according to claim 1, wherein the second substrate includes, a bypass wiring line that bypasses a wiring line, among the first wiring line and the second wiring line, that includes the circuit element coupled in series halfway in the wiring line, and a switch that is configured to select from, as a power supply path from a power source to the first element for supplying power to the first element, a first path via a wiring line in which the circuit element is coupled in series, and a second path via the bypass wiring line, and a control unit is included that, while the radio wave is received by the antenna, controls the switch to select the first path.

6. The electronic watch according to claim 5, wherein the control unit, while the radio wave is received by the antenna, controls the switch to select the first path, and in a period during which the radio wave is not received by the antenna, controls the switch to select the second path.

7. The electronic watch according to claim 5, wherein the control unit, while the first element is driven, controls the switch to select the second path, and in a period during which the first element is not driven, controls the switch to select the first path, and while the first element is driven, does not perform processing of receiving the radio wave by the antenna.

8. The electronic watch according to claim 1, wherein the antenna includes an antenna substrate, and an antenna electrode, and any member of the first substrate, the first conduction member, and the second conduction member, and the antenna substrate overlap with each other at least partially in a side view viewed from a direction orthogonal to a thickness direction of the electronic watch.

9. The electronic watch according to claim 1, wherein the antenna and the first substrate overlap with each other at least partially in plan view viewed from a thickness direction of the electronic watch.

10. The electronic watch according to claim 1, wherein the circuit element is a ferrite bead.

11. An electronic watch, comprising:

a time display unit configured to display a time;

an antenna configured to receive a radio wave;

a first substrate at which a first element that is one of a light-emitting element or a light-receiving element is mounted;

a second substrate at which a second element that is the other of the light-emitting element or the light-receiving element disposed so as to be opposed to the first element is mounted;

a gear including a through hole through which light emitted from the light-emitting element and received by the light-receiving element passes through, the gear being disposed between the first substrate and the second substrate; and a first conduction member and a second conduction member configured to electrically couple the first substrate to the second substrate, wherein the second substrate includes a first wiring line electrically coupled to the first substrate via the first conduction member, and a second wiring line electrically coupled to the first substrate via the second conduction member, a resistive element is coupled in series halfway in at least one wiring line of the first wiring line and the second wiring line, a bypass wiring line for bypassing a resistive element is coupled to a wiring line, among the first wiring line and the second wiring line, that includes the resistive element coupled in series halfway in the wiring line, a switch is provided that is configured to select from, as a power supply path from a power source to the first element for supplying power to the first element, a first path via the wiring line in which the resistive element is coupled in series, and a second path via the bypass wiring line, and a control unit is included that, while the radio wave is received by the antenna, controls the switch to select the first path, and while the first element is driven, controls the switch to select the second path.

* * * * *